US005860169A

United States Patent [19]

Machanic

[11] Patent Number: 5,860,169

[45] Date of Patent: Jan. 19, 1999

[54] STAY-DRY TOILET SEAT WITH ADJUSTABLE HINGED SUPPORT PADS

[76] Inventor: Mindy Machanic, 2270 Willow Ave., Pittsburg, Calif. 94565

[21] Appl. No.: 938,253

[22] Filed: Sep. 26, 1997

Related U.S. Application Data

[63] Continuation-in-part of Ser. No. 660,976, Jun. 12, 1996, Pat. No. 5,704,075.

[51] Int. Cl.[6] ..... A47K 17/02

[52] U.S. Cl. ..... 4/237

[58] Field of Search ..... 4/234, 237, 254, 4/480, 483, 661, 667, 905; 297/DIG. 10

[56] References Cited

U.S. PATENT DOCUMENTS

| | | | |
|---|---|---|---|
| 1,938,867 | 12/1933 | Seale | 4/254 |
| 2,060,698 | 11/1936 | Sperzel | 4/254 |
| 2,185,499 | 1/1940 | Corser | 4/237 |
| 2,241,967 | 5/1941 | Sperzel et al. | 4/237 |
| 2,598,577 | 5/1952 | Mattison | 4/237 |
| 2,928,104 | 3/1960 | Kennedy | 4/237 |
| 2,954,566 | 10/1960 | Lottenberg | 4/254 |
| 4,457,029 | 7/1984 | Matthews | 4/237 |
| 5,311,617 | 5/1994 | Ammatelli et al. | 4/237 |

FOREIGN PATENT DOCUMENTS

| | | | |
|---|---|---|---|
| 2627372 | 8/1989 | France | 4/254 |
| 27690 | of 1913 | United Kingdom | 4/237 |

*Primary Examiner*—Charles R. Eloshway
*Attorney, Agent, or Firm*—Townsend and Townsend and Crew LLP

[57] ABSTRACT

An apparatus is provided for use with a toilet bowl that keeps the user dry from moisture or other dirt found on conventional toilet seats. The apparatus includes two thigh support pads for contacting and supporting part of the backs of the thighs of a user, and two support members. Each of the support members has a top portion being rigidly coupled to a bottom side of one of the two thigh support pads. The apparatus also includes a seat frame, connectable to a back end of the toilet bowl, that connects to each of the bottom portions of the two support members. Each of the two thigh support pads has a front and a back, with the back being angled at least 25 degrees from the front, so that the two thigh support pads facilitate the user maintaining a semi-squatting position over the toilet bowl. The back of the thigh support pads is adjustably angled in relation to the front of the thigh support pads by a hinge coupling the back of the thigh support pads and the support members.

17 Claims, 6 Drawing Sheets

STAY-DRY TOILET SEAT WITH ADJUSTABLE HINGED SUPPORT PADS

CROSS-REFERENCE TO RELATED APPLICATIONS

This application is a continuation-in-part application of U.S. patent application Ser. No. 08/660,976 filed on Jun. 12, 1996, now U.S. Pat. No. 5,704,075, issued on Jan. 6, 1998, the disclosure of which is hereby incorporated by reference for all purposes.

BACKGROUND OF THE INVENTION

The present invention relates to toilets. More particularly, the present invention relates to apparatus adapted to replace or supplement a toilet seat in order to assist the user in maintaining a semi-standing or partial squatting position to comfortably facilitate evacuation of human waste products without being subjected to undesirable contact with residue, liquid, or other waste materials that often are found on conventional toilet seats in public restrooms. Although the present invention is particularly suited for use with toilet bowls in public restrooms, and especially in ladies rooms, it may also be used with toilet bowls in private homes.

Often, using a toilet in a public restroom facility becomes an unpleasant experience due to the unsanitary, dirty or wet condition of the toilet seat, which may be cleaned infrequently. When seating oneself on the toilet seat, a person sometimes inadvertently comes into unpleasant contact with toilet grime, urine/water droplets, or other liquid left by previous toilet users. In fact, many public facilities provide paper toilet seat shields to allow the user to cover the toilet seat before sitting down. However, use of paper toilet seat shields does not always provide adequate protection from the undesirable moisture that finds its way onto the toilet seat. Such paper shields are often very thin in order to reduce the amount of paper used for such shields, to prevent flushing blockage, and to reduce the amount of paper waste that ultimately gets flushed down into the sewage system. Although the paper toilet seat shields may be thin enough to account for environmental concerns, often the thin paper shields only partially absorb the moisture on the toilet seat. Therefore, upon sitting down on the supposedly protected toilet seat, the user unexpectedly comes into contact with the excess moisture that has soaked through the paper toilet seat shield. Further, placement of the paper toilet seat shield onto the toilet seat often results in the paper shield slipping into the toilet bowl before the user is even able to sit down on the toilet seat. Many times, the user enters the restroom stall only to discover that the paper toilet seat shield dispenser is empty. Therefore, the option of using paper toilet seat shields is either inadequate or non-existent. When faced with the prospect of sitting down on a soiled public toilet seat with or without the somewhat marginal protection of a paper toilet seat shield, the user is likely to opt not to sit down on the toilet seat at all. Rather, the user often resorts to bending her knees and attempting to maintain a partial squatting position over the toilet bowl in order to use the toilet without sitting down on the toilet seat. This position is often uncomfortable, precarious, and tiring, as it relies on the strength of most of the user's lower body muscles (e.g., leg, thigh, and gluteal muscles). In addition, this position also may cause more splashes on the toilet seat as the unsupported user may wobble or sway.

Accordingly, it is desirable to have a sanitary toilet accessory that assists the user in maintaining the semi-standing or partial squatting position to comfortably facilitate evacuation of human waste products while keeping the user dry and preventing undesirable contact with residue, liquid, or other waste materials that often are found on conventional toilet seats in public restrooms.

SUMMARY OF THE INVENTION

According to a specific embodiment of the present invention, an apparatus is provided for use with a toilet bowl that keeps the user dry from moisture or other dirt found on conventional toilet seats. The apparatus includes two thigh support pads, where each of the two thigh support pads has a bottom side and a top side for contacting and supporting part of a respective back of a thigh of a user. The apparatus also includes two support members, each of the two support members having a top portion and a bottom portion, with the top portion being semi-rigidly coupled to a respective the bottom side of a respective one of the two thigh support pads. The apparatus further includes a seat frame, connectable to the toilet bowl, that connects to each of the bottom portions of the two support members. Each of the two thigh support pads has a front and a back, the back being upwardly sloped relative to the front at a substantially fixed angle of at least 25 degrees with respect to horizontal. The two thigh support pads facilitate the user maintaining a semi-standing position over the toilet bowl, and the thighs of the user being supported by the thigh support pads at the angle to maintain the user in the semi-standing position during use of the toilet bowl. The back of the thigh support pads is adjustably angled in relation to the front of the thigh support pads by a hinge coupling the back of the thigh support pads and the support members.

This and other embodiments of the present invention, as well as its advantages and features are described in more detail in conjunction with the text below and attached figures.

BRIEF DESCRIPTION OF THE DRAWINGS

FIG. 4(*b*) is a detailed side view of a hinged thigh support pad according to a specific embodiment of the present invention;

DESCRIPTION OF SPECIFIC EMBODIMENTS

Figure 1:
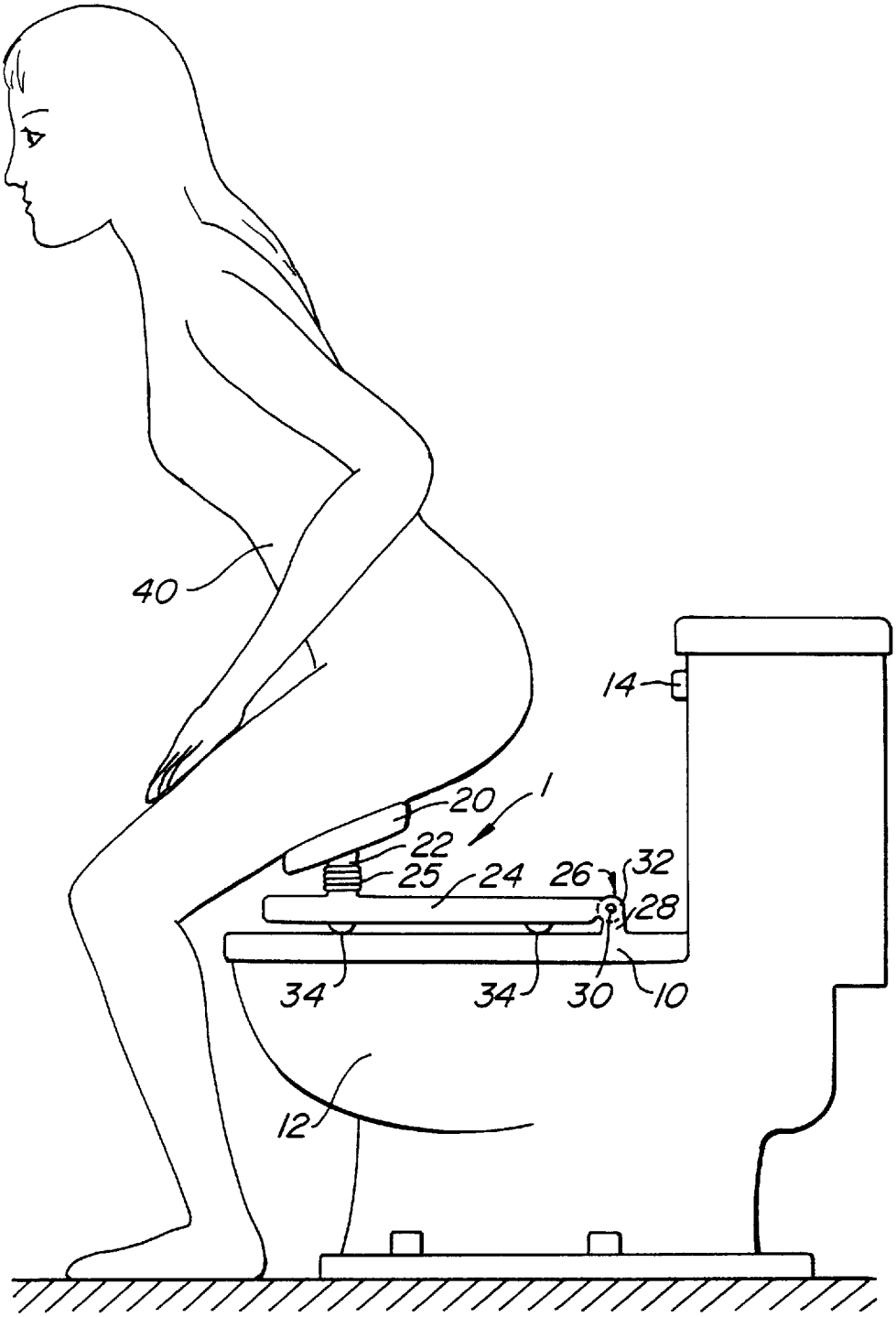
FIG. 1 is a side elevation of an embodiment of the present invention with a person shown thereon supported in a semi-standing or partial squatting position.
Figure 2:
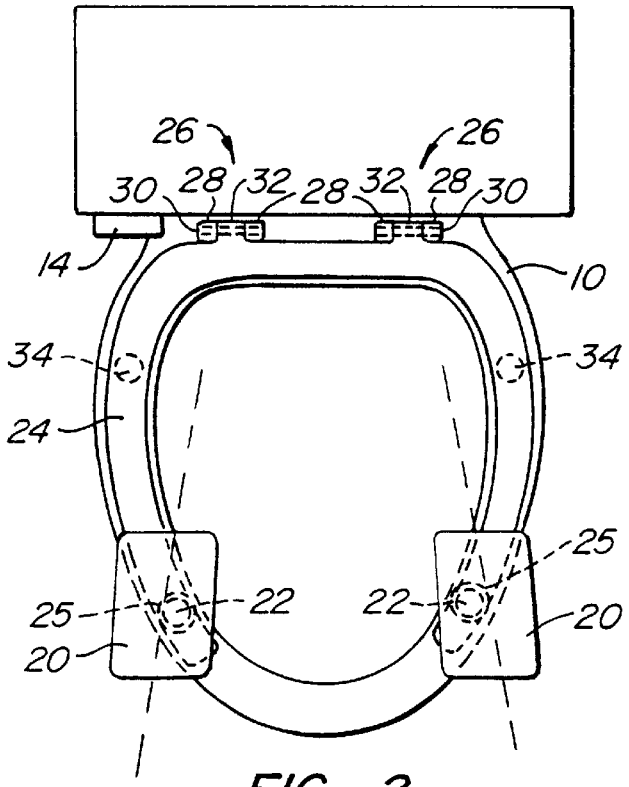
FIG. 2 is a top view of an embodiment of the present invention.
Figure 3:
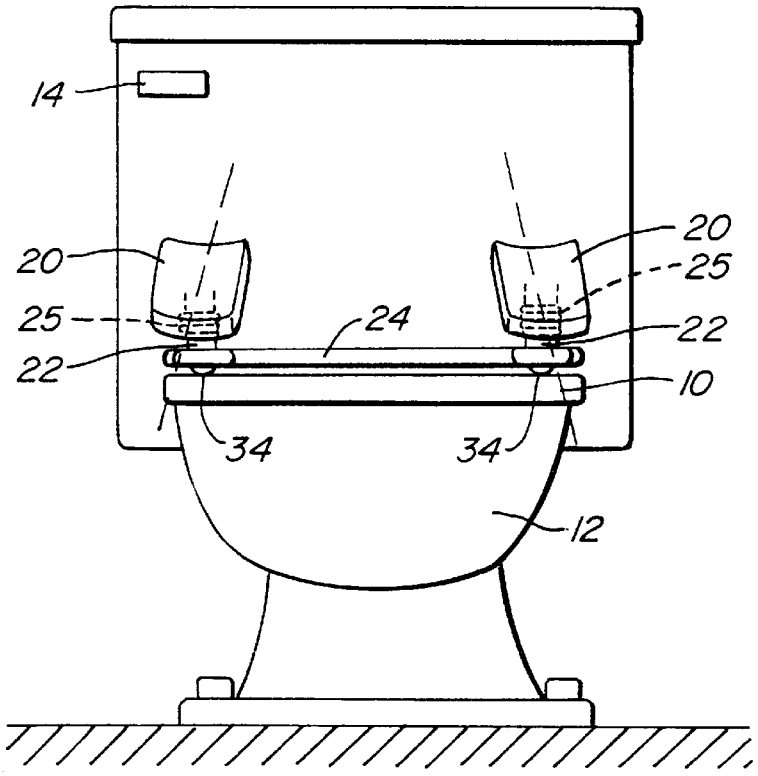
FIG. 3 is a front view of an embodiment of the present invention.

FIGS. 1–3 show different views of an embodiment of the present invention. As seen in FIG. 1, which is a side elevation of an embodiment of the present invention, the present invention is an apparatus 1 adapted to replace a conventional toilet seat. Apparatus 1 is adapted to connect to and rest on a flat rim 10 of a toilet bowl 12 to which water may be supplied through pipes (not shown) and a flush handle 14. According to a specific embodiment, apparatus 1 includes two thigh support pads 20, each of which is connected to and supported by a respective frame support member 22 that is connected to the top side of a seat frame 24. Thigh support pads 20 are angled from the front end toward the back end of seat frame 24 by at least 25 degrees. In some embodiments, the angle is between about 40 degrees to about 50 degrees, and preferably about 45 degrees. In the present embodiment, thigh support pads 20 are fixed in the angled position relative to seat frame 24. Preferably, each thigh support pad 20 may be slightly contoured to fit the shape of the back thigh for purposes of comfort. Each frame support member 22 is a thick, short rod made of a hard, slightly resilient material, such as hard rubber or resin, surrounded by an accordioned frame upright tubing 25. Frame support members 22 are preferably about 4 to 7 inches high, depending on the height of toilet bowl 12. The hard rubber material is substantially rigid and firm but has enough "give" to accommodate users having a range of different heights and weights. The combination of one of the thigh support pads 20 and its corresponding support member 22 is referred to as a thigh support subassembly 23. Seat frame 24 may be constructed of molded polymer composites, porcelain, wood, metal or other strong, suitable materials. Seat frame 24 is preferably in the general form of a horseshoe (as seen in FIG. 2), which connects one subassembly 23 at one end of the horseshoe to another subassembly 23 at the other end of the horseshoe. Of course, seat frame 24 may also be in the form of an oval ring, which would integrally connect each subassembly 23. Seat frame 24 is connected at the back end to flat rim 10 by an attachment mechanism 26.

Attachment mechanism 26 may be a hinge structure, with four protrusions 28 attached to top rim 10 in a manner such as those used to attach a conventional toilet seat to top rim 10. One exemplary attachment mechanism 26 that may be used is shown in FIG. 2 which is a top view of an embodiment of the present invention. Each of the four protrusions 28 has a circular via or hole through it for receiving a pin 30. At its back end, seat frame 24 has two extensions 32 which may be coupled to attachment mechanism 26. Each extension 32 also has a circular via through it for receiving pin 30. At two points, each of the extensions 32 is inserted between two adjacent protrusions 28, which are spaced apart appropriately, for insertion of pin 30 through extension 32 sandwiched by protrusions 28. Upon insertion and securing of pin 30 through the vias in the combination of protrusions 28 and extensions 32, attachment mechanism 26 is formed by a hinge type mechanism. Of course, attachment mechanism 26 may be any other type of mechanism used to attach conventional toilet seats to toilet bowl 12, with apparatus 1 having corresponding mating components to facilitate attachment. Accordingly, seat frame 24 provides a stabilizing structure to prevent movement of the thigh support pads 20 in relation to each other and to toilet bowl 12.

As shown in FIGS. 1–3, seat frame 24 is also equipped on its underside preferably with up to four contact members 34, which prevent full contact between seat frame 24 and flat rim 10 by providing a small amount of space between apparatus 1 and toilet bowl 12. Similar to those found on conventional toilet seats, contact members 34 of the present invention may be rounded or rectangular shaped blocks formed of hard rubber or plastic, and optionally integral to seat frame 24, for placement on flat rim 10.

As FIG. 1 demonstrates, apparatus 1 of the present invention is able to help a person 40 more comfortably maintain a semi-standing or partial squatting position without expending the full energy required to maintain that position without the present invention. Person 40 may rest her hands on her lap, or may use her hands to hold her pants gathered about her legs away from the floor and toilet bowl 12. The tilted angle design of thigh support pads 20 on frame support members 22 also may be particularly useful for elderly or handicapped users, who would not need to exert the additional effort in order to fully seat themselves in the lower seating position of the conventional toilet seat. Therefore, person 40 is able to comfortably evacuate human waste products without being subjected to undesirable contact with residue, liquid, or other waste materials that often are found on conventional toilet seats in public restrooms.

FIG. 2 is a top view of an embodiment of the present invention, and FIG. 3 is a front view of an embodiment of the present invention. FIGS. 2 and 3 illustrate that thigh support pads 20 may be turned out slightly to accommodate the increasing leg spread toward the front of toilet bowl 12 closer to the feet of person 40. Thigh support pads 20 should be at least as wide as an average thigh. Of course, thigh support pads 20 that may be wider than the average thigh would be acceptable as well, as long as the additional width is provided on the outer part of thigh support pads 20, away from the center of toilet bowl 12 in order to avoid contact with the urine stream. Thigh support pads 20 may be constructed of molded polymer composites or other suitable material that may be slightly contoured. Preferably, thigh support pads 20 may be coated with a layer of rubber or other non-slippery material to provide some traction and prevent the user's thighs from sliding off pads 20. Other embodiments may provide more creatively shaped thigh support pads 20, such as for example pads shaped like cupped hands, which would appear as if the user were supporting her thighs with hands cupped underneath. Although the embodiment shown in FIG. 2 shows that frame support member 22 has a circular cross-section, frame support member 22 may, of course, alternatively have a rectangular or other polygonal cross-section.

Figure 4A:
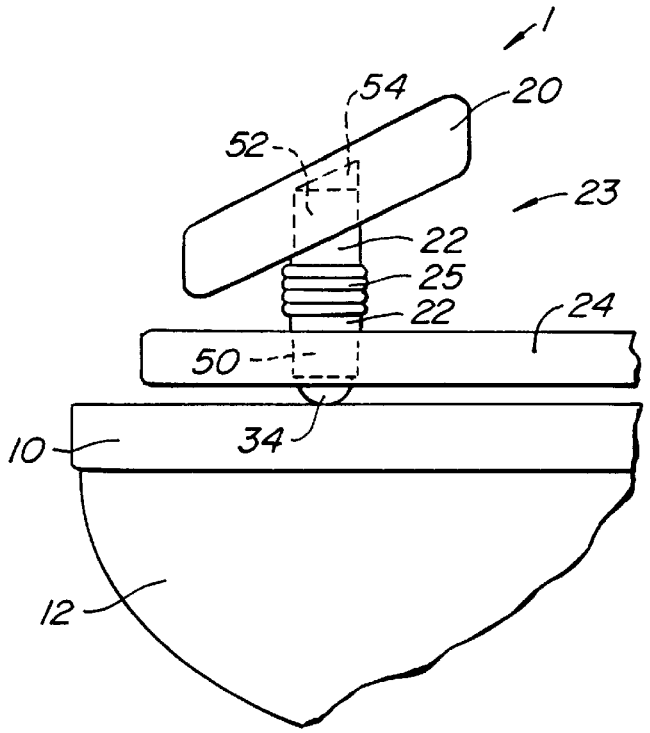
FIG. 4(*a*) is a detailed side view of the construction of a frame support member, in accordance with embodiments of the present invention.
Figure 4B:
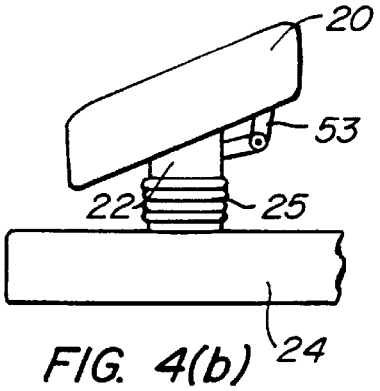

FIG. 4(*a*) is a detailed side view of apparatus 1 showing the construction of frame support member 22, in accordance with embodiments of the present invention. FIG. 4(*a*) illustrates one way in which frame support member 22 may be rigidly coupled to seat frame 24 and to thigh support pad 20. Of course, FIG. 4(*a*) also illustrates how a conventional toilet seat design may be modified to integrate another embodiment of the present invention, by replacing seat frame 24 with a conventional toilet seat. That is, another embodiment of the present invention may be implemented by providing thigh support pads 20 with frame support members 22 by simply creating a secure fastening mechanism to a conventional toilet seat. A bottom 50 of frame support member 22 has a slightly smaller cross-sectional dimension than the portion of frame support member 22 that is exposed. Bottom 50 acts as a dowel which is rigidly coupled by epoxy or other chemical or mechanical fastening techniques to seat frame 24 (or conventional toilet seat), which has a corresponding cut-out section into which bottom 50 securely fits. Similarly, a top 52 of frame support member 22 is also rigidly coupled to thigh support pad 20, according to one embodiment. Top 52 has a slightly smaller cross-sectional dimension than the portion of frame support member 22 that is exposed. As seen in FIG. 4(*a*), top 52 has a flat top surface. In an alternative embodiment, a top 54 of frame support member 22 may have an angled flat top surface (dotted line) or a multifaceted topsurface (not shown). Top 52 acts as a dowel upon which thigh support pad 20 may be affixed by epoxy of other chemical or mechanical fastening techniques. Thigh support pad 20, if solid, would have a corresponding cut-out section into which top 52 (or top 54) securely fits. Of course, if thigh support pad 20 is constructed as a molded seat fixture, similar to that of some bicycle seats, then appropriate fastening mechanisms may be used to secure thigh support pad 20 to frame support member 22. FIG. 4(*b*) is a detailed side view of an example of a hinged thigh support pad according to a specific embodiment of the present invention. As seen in FIG. 4(*b*), thigh support pad 20 in some embodiments may be coupled by a hinge 53 to frame support member 22 for slight adjustments in the tilt angle. Of course, other types of hinges as are well known in the art may also be used without departing from the scope of the invention.

Use of the present invention permits the user to stay dry by avoiding any unpleasant and unsanitary contact with toilet grime, urine/water droplets, or other liquid left by previous toilet users of conventional toilet seats. Further, the present invention removes most of the need for paper toilet seat shields. However, paper thigh support shields may be useful to protect against other solid dirt or residue that may form on thigh support pads 20. These paper shields need only be as wide as the thigh support pads 20. Therefore, the present invention allows the use of much smaller paper shields with thigh support pads 20 thereby reducing paper waste and sewage processing.

Figure 5A:
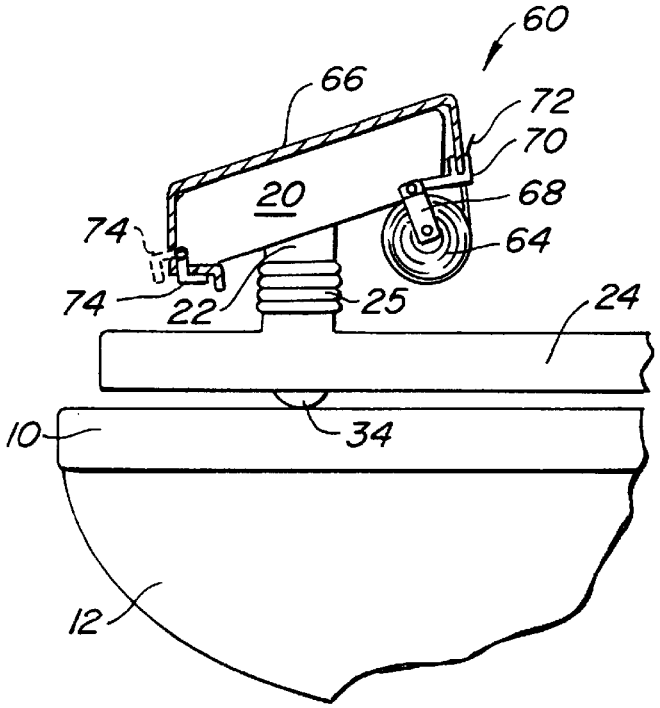
FIG. 5(*a*) illustrates an example of a paper thigh support shield dispenser that may be optionally used with the present invention, and FIG. 5(*b*) shows a simplified perspective view of parts of FIG. 5(*a*), according to an embodiment of the present invention.
Figure 5B:
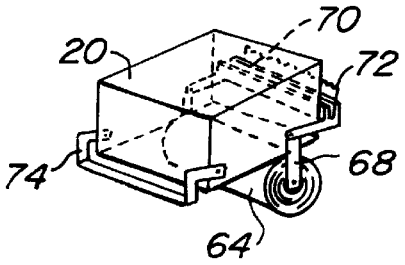

Accordingly, FIG. 5(*a*) illustrates an example of a paper thigh support pad shield dispenser 60 that may be optionally used with the present invention. Dispenser 60 includes a hanging mechanism 62 that holds a roll 64 of paper shields 66. Hanging mechanism 62 includes two arms 68 which may be conventionally fastened at one end to the sides of thigh support pads 20. The other end of arms 68 may hook onto the inside of roll 64 or, alternatively, be connected to a rod inserted in the inside of roll 64. Further, hanging mechanism 62 may be coupled to a feed-through 72 which uses a serrated edge 74 connected to the side of feed-through 72 furthest from thigh support pad 20. Feed-through 72 and serrated edge 74 may be made of sturdy plastic in a specific embodiment. Paper shield 66 may be pulled through feed-through 72 and over the top surface of thigh support pad 20, and temporarily fastened at the base of thigh support pad 20 by a dual-position clip 74. Clip 74 is shown in the retracted position, which holds an end of paper shield 66 against thigh support pad 20. Clip 74 is shown by dotted lines in the unretracted position, which facilitates the insertion of paper shield 66 through the gap between clip 74 and thigh support pad 20. FIG. 5(*b*) shows a simplified perspective view of clip 74 and hanging mechanism 62 in the unfolded position, according to an embodiment of the present invention. As seen in FIG. 5(*b*), clip 74 is fastened at each end by an appropriate fastener, such as a screw or other conventional fastener, and extends across the width of thigh support pad 20. Feed-through 72 also extends across the width of thigh support pad 20, as seen in FIG. 5(*b*). Thus, the user pulls the paper shield through feed-through 72, across thigh support pad 20, and under clip 74 for fastening in the retracted position. After use of the paper shield, the user may simply return clip 74 to the unretracted position, remove the paper shield, and dispose of the paper shield by pulling it down over serrated edge 72 in a direction away from thigh support pad 20.

Figure 6A:
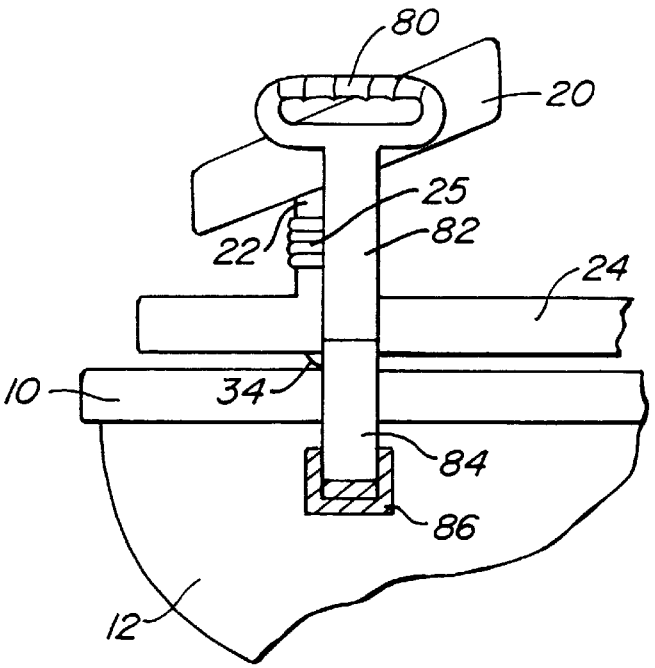
FIGS. 6(*a*) and 6(*b*) show a side view and a front view, respectively, of an example of a hand grip that may be used with the present invention in accordance with another embodiment of the present invention.
Figure 6B:
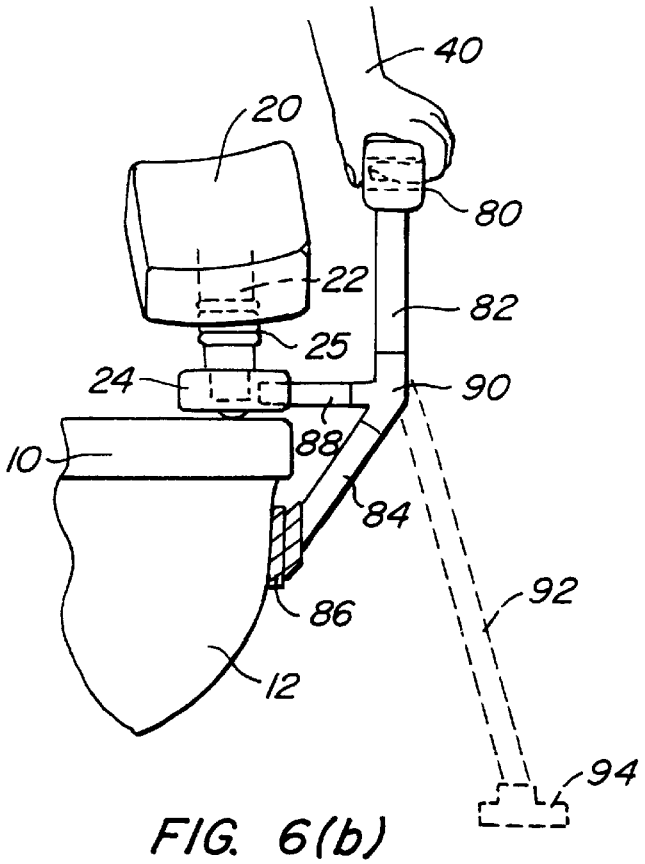

FIGS. 6(*a*) and 6(*b*) show a side view and a front view, respectively, of an example of a hand grip that may be used with the present invention in accordance with another embodiment of the present invention. As seen in FIG. 6(*a*), a hand grip 80 may be used with the present invention as an additional measure providing a sense of stability, either in remaining positioned on apparatus 1 or in moving into or off of position on apparatus 1. Hand grip 80 is a handle with a hole through which the fingers of user 40 may be inserted, as shown in FIGS. 6(*a*) and 6(*b*). Preferably, the top portion of hand grip 80 is molded for the contours of a hand and covered with rubber, polyurethane, or other gripping material to provide adequate traction. Hand grip 80 is part of a solid rod 82, which has an extending arm 84 angled toward the basin of toilet bowl 12. At one end, extending arm 84 has a rubber padding 86, which provides a grip against the side of toilet bowl 12. At the juncture of rod 82 and extending arm 84, is a frame arm 88 which is rigidly coupled to seat frame 24. Extending arm 84, provides an offset to the downward physical force that would otherwise be put on the juncture of frame arm 88 and seat frame 24. Rod 82, 84, and frame arm 88 are constructed thick enough to provide adequate strength and support, and should be preferably constructed of ceramic, metal or other strong inflexible material, preferably steel. The juncture of rod 82, extending arm 84, and frame arm 88 should be welded or otherwise strongly constructed. Of course, rod 82, extending arm 84, and frame arm 88 may be integrally formed as one piece of material. Optionally, this juncture may have a joint sleeve 90 constructed of steel or other material that provides additional stabilization and support. Further, the juncture of rod 82, extending arm 84, and frame arm 88 may also include another stabilizing ground bar 92 (dotted line) which would have a rubber boot 94 or a bolted connection to the floor. Alternatively, rod 82 with hand grip 80 may, instead of being connected to apparatus 1, extend to the floor where it would firmly anchored. Of course, bars similar to those used along the sides of handicapped restroom stalls could also be used along the walls of all restroom stalls installed with the apparatus 1. Similarly, a pair of parallel bars, each bar looping up from one point in the ground to a level close to the level of thigh support pads 20 and down to another point in the ground, may be installed as stabilizing bars for use with apparatus 1.

Figure 7A:
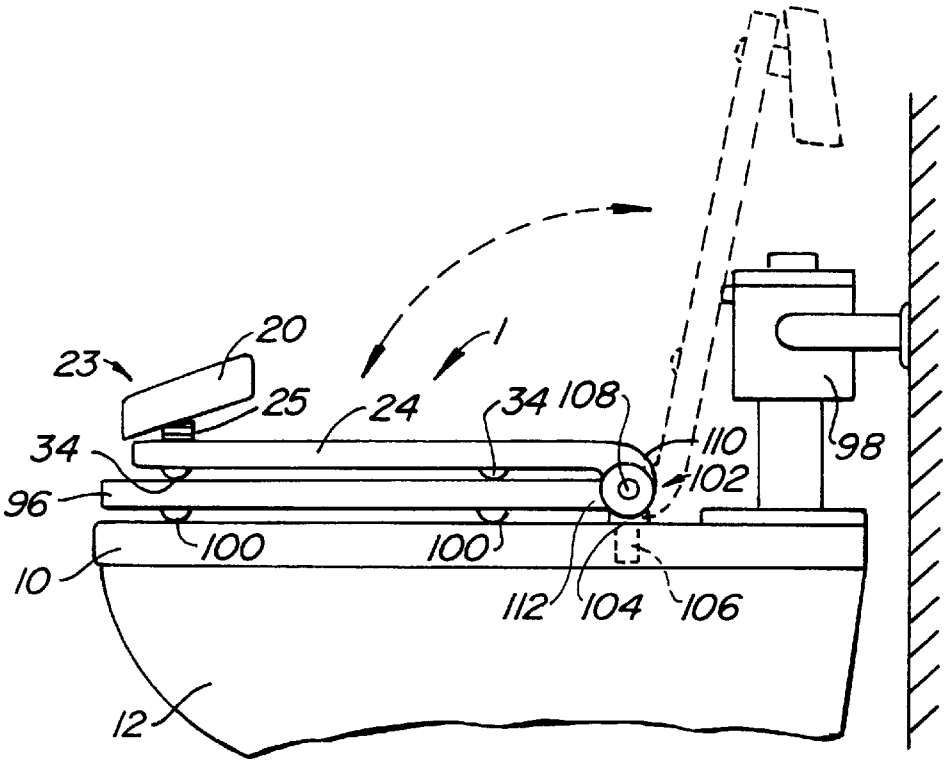
FIGS. 7(*a*) and 7(*b*) are a simplified side view and top view, respectively, of another embodiment of the present invention.
Figure 7B:
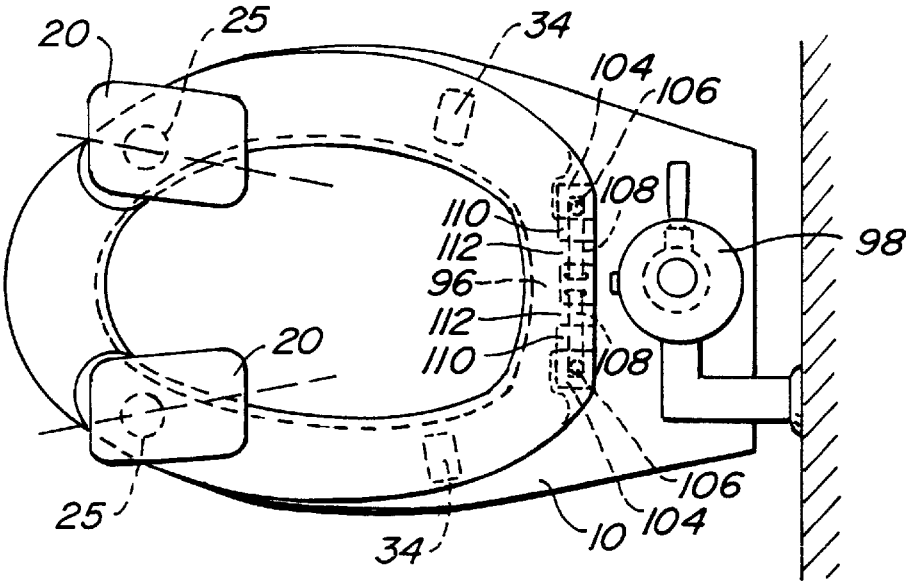

FIGS. 7(*a*) and 7(*b*) are a simplified side view and top view, respectively, of another embodiment of the present invention. As seen in FIG. 7(*a*), the present embodiment of apparatus 1 may be used with a conventional toilet seat 96 which rests on flat rim 10 of toilet bowl 12. In contrast with other embodiments which rest directly on flat rim 10, apparatus 1 rests on toilet seat 96. Accordingly, conventional toilet seat 96 may be used, if desired instead of apparatus 1, by merely lifting up apparatus 1 off toilet seat 96. Apparatus 1 and toilet seat 96 may be integrally formed in a manner similar to that of a conventional toilet seat with toilet seat cover. FIGS. 7(*a*) and 7(*b*) illustrate an industrial toilet bowl 12 which has flush control mechanism 98 attached to the wall. As shown in FIG. 7(*a*), apparatus 1 and toilet seat 96 are secured to toilet bowl 12 via another exemplary hinge mechanism 102. Mechanism 102 includes a coupling member 104 which is securely bolted by bolt 104 to flat rim 10 which has a hole for receiving bolt 104. Apparatus 1 has two connecting extensions 110 at the back end, and toilet seat 96 has two connecting extensions 112 at the back end. Each pair of connecting extensions 110 and 112, which sit adjacent to each other and to a respective coupling member 104, have vias through which respective bolts or fasteners 108 are inserted to secure hinge mechanism 102 to apparatus 1 and toilet seat 96.

Figure 8A:
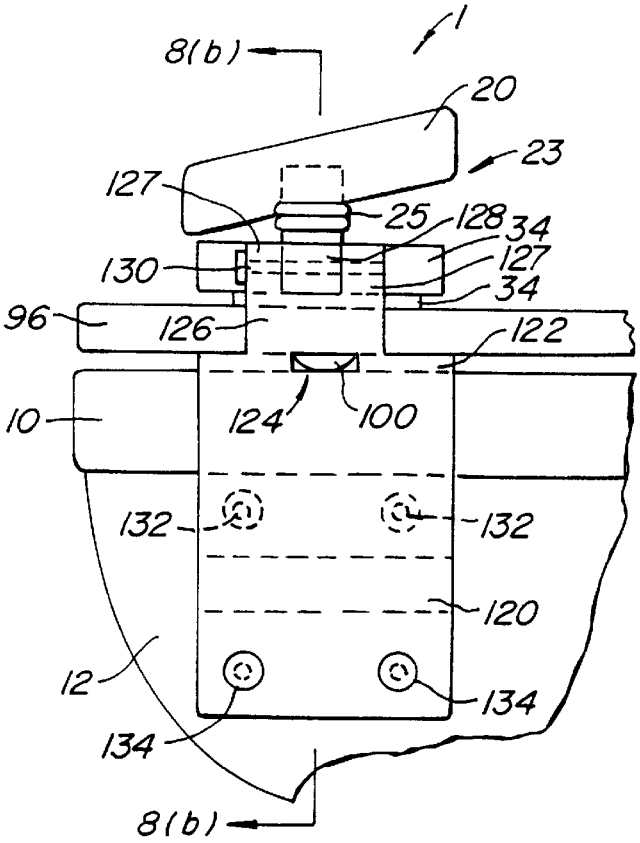
FIGS. 8(*a*) and 8(*b*) are a simplified side view and cross-sectional view, respectively, of yet another embodiment of the present invention.
Figure 8B:
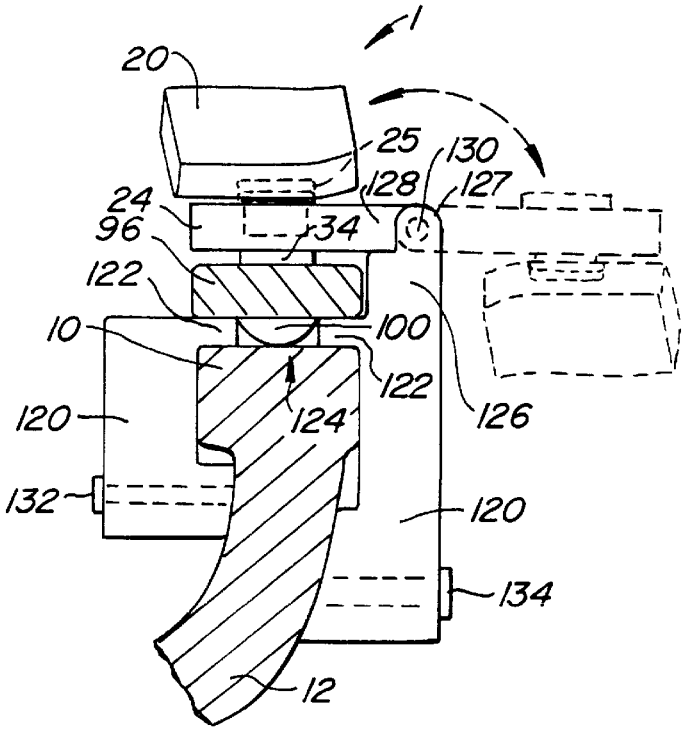

FIGS. 8(*a*) and 8(*b*) are a simplified side view and cross-sectional view, respectively, of yet another embodiment of the present invention. FIG. 8(*b*) is a cross-sectional view of FIG. 8(*a*) along dotted line 8(*b*)—8(*b*). If use of conventional toilet seat 96 is desired, thigh support subassembly 23 may be lifted off and away from toilet seat 96, which may be accommodated by this embodiment of apparatus 1. In this embodiment, each thigh support subassembly 23 is anchored to a respective large, toilet base clamp 120. Flat portion 122 of clamp 120 overhangs flat rim 10 while the sides of clamp 120 sandwich the side of toilet bowl 12. Portion 122 of clamp 122 has a cut-out hole 124 for allowing contact member 100 of conventional toilet seat 96 to rest on flat rim 10 of toilet bowl 12. Cut-out hole 124 also serves to help stabilize apparatus 1 in relation to toilet seat 96. Clamp 120 also has a block protrusion 126 that extends above portion 122 and is adjacent to part of toilet seat 96. Block protrusion 126 is integral to clamp 120. In the present embodiment, apparatus 1 also includes a seat frame 24 (truncated in comparison to other embodiments) which has at its outer side an extension 128. Two hinge protrusions 127 extending from block protrusion 126 are adjacent to and sandwich extension 128, which partially rests on block protrusion 126. Hinge protrusions 127 and extension 128 each have vias in-line through which a large pin 130 is inserted and rotatably secured. Thus, block protrusion 126 with hinge protrusions 127 serves as a mounting point for a long hinge mechanism formed by hinge protrusions 127, extension 128, and pin 130, in accordance with the present embodiment. Clamp 120 is secured to toilet bowl 12 using bolts 132 and 134 for the inside and outside, respectively, of toilet bowl 12. Clamp 120 and block protrusion 126 must be large and strong enough to provide the stable base required to support subassembly 23.

The present invention has been explained with relation to specific embodiments. It is to be understood that the above description is intended to be illustrative and not restrictive. Many embodiments will be apparent to those of skill in the art upon reviewing the above description. For example, in other embodiments, thigh support pads 20 may be semi-rigidly fixed in variable angled positions relative to seat frame 24 by the use of a secure, hinge connected to allow adjustment of the top portion of the bottom of thigh support pads 20 in relation to frame support members 22. As a further example, thigh support pads 20 may be integrated as part of a conventional toilet seat which would include ramped portions that conform to the back of the user's thighs and are angled to support the semi-squatting position. As yet another example, hinge mechanisms 26 or 102 may be different types of connecting mechanisms. The scope of the invention should, therefore, be determined not with reference to the above description, but should instead be determined with reference to the appended claims, along with the full scope of equivalents to which such claims are entitled.

What is claimed is:

1. Apparatus for use with a toilet bowl, said apparatus comprising:

two thigh support pads, each of said two thigh support pads having a bottom side and a top side, said top side for contacting and supporting part of a respective back of a thigh of a user;

two support members, each of said two support members having a top portion and a bottom portion, said top portion being coupled to a respective said bottom side of a respective one of said two thigh support pads; and a seat frame, said seat frame connectable to the toilet bowl, and said seat frame connecting to each of said bottom portions of said two support members; and wherein each of said two thigh support pads has a front and a back, said back being upwardly sloped relative to said front at a substantially fixed angle of at least 25 degrees with respect to horizontal, said two thigh support pads facilitating the user maintaining a semi-standing position over the toilet bowl, said thighs of the user being supported by said thigh support pads at said angle to maintain the user in said semi-standing position during use of the toilet bowl; and wherein said apparatus further includes two hinges, each hinge having one end connected to a respective back of one of said support pads and an opposite end connected to a respective support member to allow slight tilting of said support pads relative to said support members.

2. The apparatus of claim 1 wherein each said top side of said two thigh support pads is contoured to accommodate a respective back of the thigh of the user.

3. The apparatus of claim 1 wherein a first distance between the respective backs of each of said two thigh support pads is less than a second distance between the respective fronts of each of said two thigh support pads.

4. The apparatus of claim 1 wherein said seat frame has mating holes therein, said bottoms of said support members being disposed and secured in said mating holes.

5. The apparatus of claim 1 wherein said seat frame comprising a toilet seat including mating holes provided therein, said bottoms of said support members being disposed and secured in said mating holes.

6. The apparatus of claim 1 further comprising supporting structures for assisting the user to maintain a comfortable position on said thigh support pads, said supporting structures located with respect to said thigh support pads such that the hands of the user are capable of grasping said supporting structures while said thighs of the user are supported on said thigh support pads.

7. The apparatus of claim 6 wherein said supporting structures comprise a hand grip connected to one end of a rod, said rod having a juncture at the other end, a frame arm rigidly coupled to said seat frame at one end and coupled to said juncture at the other end, and an extending arm coupled to said juncture at one end and coupled to a side of the toilet bowl at the other end, the other end of said extending arm covered by a padding.

8. The apparatus of claim 7 wherein said supporting structures further comprise a stabilizing ground bar coupled at one end to said juncture and firmly coupled to the ground at the other end.

9. The apparatus of claim 1 wherein said angle is about 40 to 50 degrees.

10. The apparatus of claim 1 wherein said seat frame is integral with a toilet seat, wherein the toilet seat is also connectable to the toilet bowl.

11. Apparatus for use with a toilet bowl, said apparatus comprising:

means for supporting backs of thighs of a user of the toilet bowl, said supporting means including two thigh support pads respectively having a front and a back, said support pads for contacting and supporting the backs of the thighs of the user;

means for stabilizing one of said two thigh support pads in relation to the other of said two thigh support pads and for stabilizing said supporting means in relation to the toilet bowl; and wherein said two thigh support pads are positioned such that said backs of said thigh support pads are upwardly sloped relative to said fronts of said thigh support pads at a substantially fixed angle of at least 25 degrees from horizontal to facilitate user maintaining a semi-standing position over the toilet bowl, said angle of said thigh support pads facilitating said user to maintain said semi-standing position during use of the toilet bowl; and wherein said apparatus further includes two hinges, each hinge having one end connected to a respective back of one of said support pads and an opposite end connected to said means for supporting to allow slight tilting of said support pads relative to said supporting means.

12. The apparatus of claim 11 wherein said supporting means includes two support members, each coupled respectively to one of said two thigh support pads.

13. The apparatus of claim 11 wherein said stabilizing means includes a seat frame.

14. The apparatus of claim 11 further comprising means for assisting the user to maintain said semi-standing position on said supporting means by enabling the user to manually stabilize said semi-standing position comfortably.

15. The apparatus of claim 14 wherein said assisting means is coupled to said stabilizing means.

16. The apparatus of claim 11 wherein said angle is about 40 to 50 degrees.

17. The apparatus of claim 11 wherein a toilet seat may be used instead of said two thigh support pads, said two thigh support pads capable of being moved out of the way of the toilet seat, wherein the toilet seat is coupled to said thigh support pads.

* * * * *